United States Patent [19]

Khazin

[11] 4,145,771

[45] Mar. 27, 1979

[54] TOILET COVER LOCK

[76] Inventor: Glenda M. Khazin, 4635 Lyons Dr., La Mesa, Calif. 92041

[21] Appl. No.: 896,448

[22] Filed: Apr. 14, 1978

[51] Int. Cl.[2] ..... A47K 13/24

[52] U.S. Cl. ..... 4/253; 24/16 PB; 292/87

[58] Field of Search ..... 4/253, 242, 234; 24/16 PB, 230 TC, 206 A, 201 A; 292/262, 31, 91, 87, DIG. 38, DIG. 29

[56] References Cited

U.S. PATENT DOCUMENTS

| | | | |
|---|---|---|---|
| 3,254,688 | 6/1966 | Everburg | 24/201 A |
| 3,403,430 | 10/1968 | Steinborn | 24/16 PB |
| 3,477,070 | 11/1969 | Kimber | 4/253 |
| 3,721,750 | 3/1973 | Countryman | 24/16 PB |
| 3,739,430 | 6/1973 | Kohke | 24/16 PB |
| 4,042,265 | 8/1977 | Chezem | 292/262 |

*Primary Examiner*—Richard E. Aegerter
*Assistant Examiner*—L. Footland
*Attorney, Agent, or Firm*—Brown & Martin

[57] ABSTRACT

A locking device for use with a toilet provided with a seat and cover or lid assembly. The device provides the locking of the cover to the toilet bowl so as to prevent access to the interior of the bowl by small children or persons lacking knowledge of its operation or suitable dexterity. A flat locking strap of suitable length is secured at one end to the top of the toilet seat cover. The strap is provided with a tapered section near its free end which terminates in a grippable handle. A lock cylinder is attached to the toilet bowl exterior in position to receive the tapered section of the locking strap. The lock cylinder has a longitudinal slot and internal bore sized to permit only an edgewise insertion or removal of the tapered section of the locking strap. When the toilet cover is lowered and the locking strap inserted and turned flat within the lock cylinder further movement of the locking strap is prevented, thus locking the toilet seat cover closed. The toilet cover lock is easily mounted and when unlocked causes no interference with the normal usage of the toilet seat and cover.

3 Claims, 3 Drawing Figures

TOILET COVER LOCK

BACKGROUND OF THE INVENTION

The proper use of a toilet is often a matter of concern in situations involving its availability to small children or persons with equivalent knowledge and dexterity, such as the mentally retarded. Toilets are often attractive to children as a source of water with which to play, and the flushing action can be a source of fascination and amusement. Until maturity or training can be achieved, such use is a matter of annoyance and concern.

Playing in the toilet water is both messy and unsanitary. There is also the continual hazard of objects being flushed down the toilet which will clog the drainage system, requiring consequent expensive clearing operations. It is often not feasible to supervise the activity of children continually, or desirable to deny their access to the bathroom basin or other facilities by securing a door to avoid their playing in the toilet. It is therefore desirable to provide a lock that will prevent access to the interior of the toilet bowl for play yet be easily operated by adults, and which will cause no interference with the intended use of the toilet when unlocked. Further, such a locking device should be plain in form, easily installed and cleaned, and not be subject to corrosion.

The toilet cover lock disclosed herein fulfills the requirements outlined. It may also be used as a simple securing device for other containers. By lengthening the locking strap, provision can be made for use of the device to afford limited opening of containers or other closures when required.

SUMMARY OF THE INVENTION

The invention relates to a toilet cover lock for use on toilet fixtures equipped with a seat and cover or lid assembly. The device is easily installed and when in the locked position holds the cover and seat securely against the rim of the toilet bowl to prevent access to the interior of the bowl. It is designed to prevent access by small children and others of equivalent knowledge and dexterity, but is easily released by more mature or developed persons.

The toilet cover lock has three plastic components. A flat, pliable, and elongated locking strap of generally rectangular shape is secured at one end to the top of the toilet cover. The opposite end of the locking strap is provided with a grappable handle used for manipulation of the strap in performing the locking and unlocking function. The locking strap has a tapered section located adjacent to the handle wherein its width is substantially reduced. A flat bridge-shaped mounting bracket is attached to the top of the toilet cover to secure the fixed end of the locking strap. Prior to attaching the mounting bracket, the fixed end of the locking strap is slipped under and into a recess of the mounting bracket so that the bracket will hold the strap within it and against the top of the toilet cover. The positioning of the mounting bracket also establishes the alignment of the toilet cover lock and its basic flat orientation The toilet cover lock assembly is completed by a lock cylinder which is attached to the side of the toilet bowl in line with the locking strap. The lock cylinder is formed as a molded piece having a flat base. The cylindrical portion has a longitudinal slotted opening in the cylinder wall located to be in line with the mounted locking strap. The slot in the lock cylinder and the interior cylinder bore are sized to accommodate the entry and retention of the tapered portion of the locking strap when the latter is turned edgewise for entry or removal, and then rotated flat for locking. The lock cylinder is positioned on the exterior of the toilet bowl in cooperation with the length of the locking strap so as to hold the toilet cover and seat securely against the rim of the toilet bowl when the locking strap is in the locked position. In the flat or locked orientation, longitudinal movement of the locking strap is substantially prevented by the width of the handle on one side of the lock cylinder, and the increasing taper of the locking strap on the other side of the cylinder. The minimum width of the tapered section is such as to prevent the passage of the locking strap tapered section through the cylinder slot when the locking strap is flat.

The primary object of the invention is to provide a new and improved toilet cover lock which when installed will prevent access to the interior of a toilet bowl by small children. It is a further object to provide a toilet cover lock that is easily installed and operated by mature persons, and one that does not interfere with normal toilet usage when not in the locked position. The components of the toilet cover lock may easily be cleaned, are not subject to corrosion, and are pliable to facilitate their use and to avoid injury. These together with other objects and advantages which will become apparent in considering the details of construction and operation of the toilet cover lock as they are more fully described. Reference will be made to the accompanying drawings wherein like numerals refer to like parts throughout and in which:

DETAILED DESCRIPTION OF THE DRAWINGS

Figure 1:
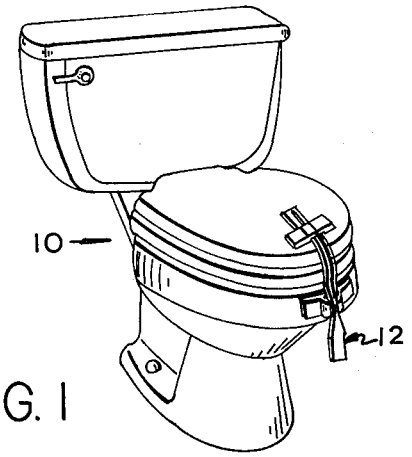
FIG. 1 is a perspective of the toilet cover lock installed on a closed toilet fixture.

A typical toilet fixture equipped with a seat and cover is shown at 10 in FIG. 1. A cover locking assembly 12 is depicted mounted on the fixture 10 in the locked down position.

Figure 2:
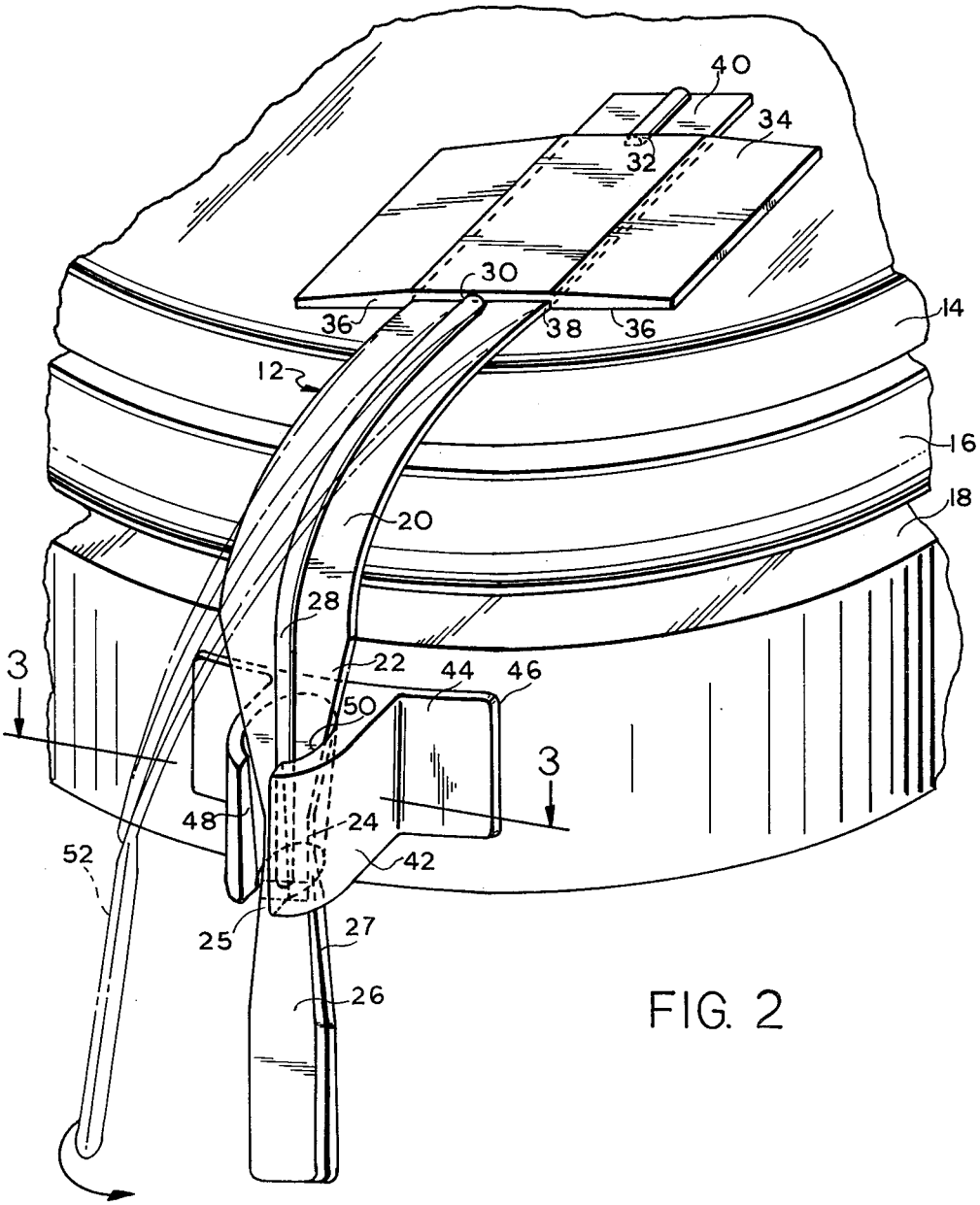
FIG. 2 illustrates the detailed features in mounting of the toilet cover lock and also depicts a position thereof just prior to locking.

The components of the cover lock assembly 12 and their mounting is illustrated in FIG. 2. Locking strap 20 is a pliable flat element with rectangular shape for the major portion of its length. Locking strap 20 is provided with a tapered section 22 beginning near its free end and which leads into a straight portion of minimum width 24. Locking strap 20 terminates in a grippable handle 26. A tapered transition portion 27 of locking strap 20 connects the minimum width section 24 to handle 26. Handle 26 is both wider and thicker than the minimum width and thickness of the straight section 24 of the locking strap 20, and is used to manipulate the locking strap in operation of toilet cover lock 12. An integral beading 28 is formed in the upper surface of locking strap 20 at its mid-width, and runs from the interior end 25 of handle 26 to the opposite end of locking strap 20. Beading 28 serves to give added strength and rigidity to locking strap 20 for greater serviceability and longer wear. There is a cut out or notched section in beading 28 between points 30 and 32 so sized and spaced as to accommodate the placement of the mounting bracket 34 within the beading notch when attaching locking strap 20 to the top of toilet cover 14. In the described embodiment locking strap 20 is made of molded polypropylene plastic. Other plastics or rubber could, however, be used in the application.

Mounting bracket 34 is relatively flat bridge-shaped element having a flat surface 36 for mounting. A recess 38 is formed in the mid-length of the flat surface of mounting bracket 34 and sized and spaced to accommodate the width and depth of locking strap 20 when the mounting bracket 34 is placed over the locking strap 20 and within the beaded notch interval between points 30 and 32 of beading 28. With the locking strap 20 so positioned, mounting bracket 34 serves to secure the fixed end 40 of locking strap 20 to the top of the toilet cover 14 when its flat surface 36 is attached thereto. The position of mounting bracket 34 also serves to align and space locking strap 20 in relation to lock cylinder 42 for installation, and establish its flat or "locked" orientation.

Also shown in FIG. 2 is the lock cylinder 42. This molded plastic piece is in the shape of a hollow cylinder lying on base 44 which has a flat mounting surface 46. Lock cylinder 42 contains a longitudinal slot 48. The dimensions of slot 48 and the interior bore 50 of lock cylinder 42 are such as to accommodate the edgewise entry and turning of the minimum width straight section 24, and the immediately adjacent tapered portions 22 and 27 of lock strap 20. However, once locking strap 20 is inserted through slot 48 and turned flat, it may not be removed from lock cylinder 42.

Lock cylinder 42 is attached to the exterior of toilet bowl 18 near the rim by attaching its flat surface 46 to the toilet bowl. To make the toilet cover lock installation, toilet seat 16 and cover 14 are first lowered to rest upon the rim of toilet bowl 18. Mounting bracket 34 and lock cylinder 42 are then positioned on toilet cover 14 and toilet bowl 18 respectively to obtain a separation between them that results in a firm connection of toilet cover 14 to toilet bowl 18 when the fixed end of locking strap 28 is secured to the top of cover 14 and its tapered section 24 is held within lock cylinder 42.

In the described embodiment, mounting bracket 34 and lock cylinder 42 are made of ABS Plastic, but substitute materials could be used. Double faced adhesive strips of appropriate length are used to attach mounting bracket 34 and lock cylinder 42 to the toilet cover 14 and toilet bowl 18 respectively.

OPERATION

With the toilet cover unlocked and raised, locking strap 20 projects beyond the periphery of the cover, but it does not present interference to the normal usage of the toilet. In addition, its pliable structure avoid injury should the cover fall with someone nearby.

Figure 3:
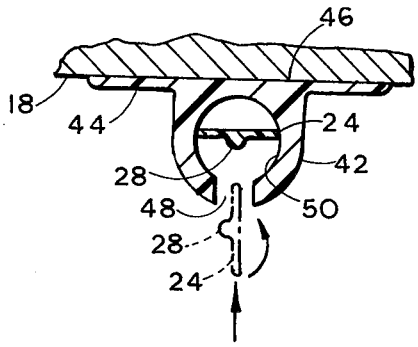
FIG. 3 is a sectional view of the lock cylinder along the line 3—3 showing the locking strap in the locked position.

To lock the toilet, toilet seat 16 and cover 14 are lowered to rest on the rim of the toilet bowl 18. Handle 26 of locking strap 20 is gripped and given a half turn. This action readies the edge of locking strap 20 in the region of straight section 24 and adjacent tapers 22 and 27 for insertion through slot 48 and into cylinder bore 50, as depicted in the dotted position 52 of FIGS. 2 and 3. The above described sections of locking strap 20 are then inserted into locking cylinder 42 through slot 48 and given reverse half turn to a flat position to lock the toilet cover to the bowl. FIG. 3 illustrates the locked position of locking strap 20 secured within locking cylinder 42. A reverse of the described procedure would be used in withdrawing locking strap 20 from lock cylinder 42 to permit raising the toilet cover.

Having described my invention, I now claim:

1. A toilet cover lock usable on toilets equipped with a seat and cover assembly, comprising:

a pliable and resilient locking strap having one end securable to the top of the toilet seat cover and of such length as to reach the side of the toilet bowl, said lock strap having a grippable handle at its free end and a narrowed tapered section adjacent thereto, a mounting bracket to attach said securable end of said locking strap to the top of the toilet cover, a slotted lock cylinder with an interior bore wider than the slot, mounted on the side of the toilet bowl in operable relationship to said mounting bracket and said locking strap to receive and secure said locking strap at said narrowed tapered section thereof and within said grippable handle, means for attaching said mounting bracket and said lock cylinder to the top of the toilet cover and bowl respectively.

2. A toilet cover lock usable on toilets equipped with a seat and cover assembly as recited in claim 1, wherein:

said locking strap is formed as a flat element with rectangular shape for the major portion of its length, and wherein said grippable handle is under and thicker than said tapered section, said locking strap having an integral raised beading formed in the middle of one side thereof and extending from said handle to the opposite end of said locking strap, said raised beading containing a notch near said securable end of said locking strap, said mounting bracket having a flat side with a recess formed therein to the width and depth of said locking strap and fittable into said beading notch in securing said locking strap to the top of said toilet cover with said mounting bracket.

3. A toilet cover lock usable on toilets equipped with a seat and cover assembly as recited in claim 1, and wherein said lock cylinder has a flat base for mounting against the side of the toilet bowl, and wherein said lock cylinder slotted opening is longitudinal and said lock cylinder has an interior bore sized to permit edgewise entry of said locking strap at said tapered section thereof but preventing movement of said locking strap when it is turned flat after insertion into said cylinder bore.

* * * * *